US006960267B1

(12) United States Patent
Nixon, III

(10) Patent No.: US 6,960,267 B1
(45) Date of Patent: Nov. 1, 2005

(54) MULTI-COMPONENT LIQUID EXPLOSIVE COMPOSITION AND METHOD

(76) Inventor: William P. Nixon, III, 10928 E. Shelby Dr., Collierville, TN (US) 38017

( * ) Notice: Subject to any disclaimer, the term of this patent is extended or adjusted under 35 U.S.C. 154(b) by 0 days.

(21) Appl. No.: 10/606,853

(22) Filed: Jun. 26, 2003

(51) Int. Cl.[7] ..... C06B 45/00; D03D 23/00
(52) U.S. Cl. ..... 149/2; 149/109.6
(58) Field of Search ..... 149/2, 109.6

(56) References Cited

U.S. PATENT DOCUMENTS

| | | | | |
|---|---|---|---|---|
| 3,338,165 | A | 8/1967 | Minnick | 102/27 |
| 3,718,512 | A | 2/1973 | Hurst | 149/2 |
| 3,747,679 | A * | 7/1973 | Roberts | 166/299 |
| 3,977,921 | A | 8/1976 | Chandler | 149/2 |
| 4,097,316 | A * | 6/1978 | Mullay | 149/2 |
| 4,115,165 | A | 9/1978 | Machacek | 149/5 |
| 4,330,346 | A * | 5/1982 | Alm et al. | 149/21 |
| 4,925,505 | A | 5/1990 | Baker et al. | 149/89 |
| 5,226,986 | A | 7/1993 | Hansen et al. | 149/109.6 |
| 6,405,627 | B1 | 6/2002 | Anderson | 89/1.13 |

* cited by examiner

*Primary Examiner*—Aileen Felton
(74) *Attorney, Agent, or Firm*—Walker, McKenzie & Walker, P.C.

(57) ABSTRACT

A multi-component liquid explosive composition and method of mixing thereof. The steps include (a) providing a powder consisting of aluminum preferably having an average particle size of 5 to 50 microns and a surface area of 0.5 to 2 square meters per cubic centimeter containing 0.1 to 5% stearic acid by weight; (b) providing a liquid consisting of nitromethane; and (c) mixing said aluminum powder with the nitromethane to form a liquid explosive formulation detonable at a wide range of temperatures and diameters with a standard commercial number 8 blasting cap.

6 Claims, 1 Drawing Sheet

MULTI-COMPONENT LIQUID EXPLOSIVE COMPOSITION AND METHOD

BACKGROUND OF THE INVENTION

1. Field of the Invention

The present invention relates, in general, to explosives and explosives manufacturing.

2. Background Art

In the field of explosives and explosives manufacturing, there are many types of explosives made for various applications. A few of these applications are for mining, construction, demolition, law enforcement and military uses. There are a multitude of explosive products available to satisfy the requirements in these fields. For example, for blasting rock in mining and construction work, the user can choose from cartridged explosives such as dynamite, water-gels and emulsions which are used for small diameter bore holes (up to 3 inches). For larger boreholes, blasting agents are used in the form of Ammonium Nitrate/Fuel Oil mixtures (ANFO), which are poured or pumped into position. Unlike the smaller, "cap-sensitive" cartridged explosives, these blasting agents (by definition) require a small, high explosive booster to initiate the detonation thereof.

For commercial demolition applications, cartridged explosives are placed in small boreholes within concrete columns and beams in the case of buildings, bridges and other similar structures. Where steel needs to be cut, small but powerful high explosive shaped charges are used to sever critical points in order to complete the demolition.

Military applications for explosives are many. However, they tend to fall into two main groups. The first is for bombs, artillery shells, mortars, mines, etc. For these uses, the explosives are generally placed into the devices by means of a melt-pour operation. The second group are explosives used for demolition and breaching by Special Forces and engineering groups. Although some of the explosive charges are pre-made devices incorporating shaped charge or Explosively Formed Projectile (EFP) technology, most are simply bulk explosives in the form of blocks (C-4, and TNT) or sheets (Deta-Sheet).

Another military related use of explosives is demining operations and unexploded ordnance (UXO) clearing operations where explosive charges are used to sympathetically detonate and destroy landmines as well as "dud" bombs and artillery shells. Similar type work conducted by civilian contractors after a conflict has been termed "Humanitarian Demining". Clearing of old military firing ranges by these contractors is called remediation.

Although the previously mentioned applications consume the bulk of the explosives used in the world, smaller quantities are also used for the following purposes:

Agricultural blasting such as tree stump removal, irrigation and drainage ditch blasting and beaver dam control;

Avalanche control;

Metal hardening;

Forest fire fighting;

Submarine (underwater) blasting;

Seismic work;

Secondary blasting such as boulder breaking;

Law enforcement applications such as tactical breaching and bomb squad work.

Due to threats of terrorism and increased attention to accident prevention, regulations concerning the transportation, storage, use and transfer relating to explosives have steadily increased over the last few years. Along with this has come an increase in the cost of using explosives, particularly, in the area of transportation.

Where explosives are used in volume, such as mines and quarries, the cost of transporting a truckload of explosives is not much more than a truckload of any other material. However, where small amounts of explosives are required, the transportation costs can far exceed the cost of the product. For example, it costs just as much to transport one stick of dynamite by commercial truck as it does two thousand pounds of dynamite. In order to accommodate the user who needs smaller quantities to do a job, "binary" or "two-part" explosives are available. One popular brand is called Kinepak. It appears that this product is based on U.S. Pat. No. 3,718,512 by Hurst. As described in the Hurst patent and embodied in the commercially available product Kinepak, two individual, nonexplosive components are combined by the user to form a cap sensitive explosive. The first component, referred to as "the liquid" is predominantly nitromethane (NM). The other component, referred to as "the solid" is primarily finely divided ammonium nitrate (AN). The commercial product Kinepak is packaged in several different sizes and shapes of plastic bottles as well as foil pouches (bags) which are intended for various applications. In each case, the solid component container is supplied with an appropriate amount of premeasured liquid in another individual container.

The liquid component of the Kinepak is classified as a "Flammable Liquid" for transportation purposes. The solid component is classified as an "Oxidizer". Although both are considered hazardous materials, neither is defined as an explosive for transportation (U.S. Department of Transportation, DOT regulations) or storage (U.S. Bureau of Alcohol, Tobacco and Firearms, ATF regulations).

In order to use Kinepak, the liquid component is simply poured into the solid component. Within about five to fifteen minutes, the liquid (which is usually colored red) will soak down to the bottom of the container, as evidenced by the pink color. At this point, it has the consistency of moist powder and is a cap sensitive, high explosive. It can be used in most situations where it would be suitable to use cartridged explosives such as dynamite, water gels and small diameter emulsions.

Kinepak is used as an example here because it is, at the time of this writing, one of the only two commercially available two-component explosives. The only other known commercial product is marketed under the name Binex. It is believed to be based upon U.S. Pat. No. 5,226,986 to Hansen, et al. Binex uses a two component system of an aqueous solution of sodium perchlorate and aluminum powder. When these two components are combined, a liquid explosive is formed that is cap sensitive. It is believed that this composition would not be a viable product as a replacement for cartridged explosives because of the high cost and the environmental concerns with the sodium perchlorate solution. However, there is a current military application where this product is used to blast fox holes in conjunction with an entrenchment kit for soldiers. It is known that this explosive has detonation velocity that is much lower than Kinepak and other commercial cartridged explosives. In the case of the military application, this is an advantage as lower velocity explosives are generally better for cratering in soil.

There are many other possible candidates for use as binary explosives. However, most of these others would not be viable for consideration as commercial products for the following reasons:

toxicity of the components and/or detonation products;

stability of the components before and after mixing;

shelf life;
cost;
ease/difficulty of mixing;
no advantages when compared to ammonium nitrate/nitromethane systems (Kinepak).

In most binary systems, like the ones mentioned previously, one of the components is an oxidizer (ammonium nitrate, sodium perchlorate) and the other is a fuel (nitromethane, aluminum). As with all explosives, the potential uses and effects are determined by several properties such as detonation velocity, density, gas production, etc. Effects on a specific target can be influenced by container size, shape and confinement. For example, configuring the explosive in a shaped charge container will cause more of the available energy to be focused toward a given target than would be possible otherwise. The type of initiation system required and utilized will also have an effect, especially with blasting agents such as ANFO.

Ammonium nitrate and nitromethane (AN-NM) binary systems such as Kinepak work very well for their intended purpose. They have the following advantages over conventional explosives:

The components are not explosives before mixing;
The components do not have to be transported as explosives;
The components do not have to be stored as explosives (in most places) therefore do not require expensive storage "magazines".

The above listed advantages are due to the fact that they are mixed on site just before using.

However, there are a few disadvantages:

Mixing can be time consuming;
Shelf life of the ammonium nitrate powder can be short depending on conditions, particularly temperature;
Can cost 2 to 3 times more than conventional explosives (this must be weighed against the advantages above).

As mentioned previously, although other systems besides AN-NM exist, there has not been a commercially viable product available as a substitute for conventional small diameter cartridge explosives.

There are other binary systems based on nitroparaffins such as nitromethane, nitroethane, nitropropanes, etc. These nitroparaffins are very interesting materials. Under the right circumstances, they can act as a fuel (as when combined with ammonium nitrate) an oxidizer or a stand alone explosive, especially nitromethane. However, as will be discussed later, they are too insensitive to be used as explosives as is.

There are several patents that attempt to utilize nitroparaffins as the basis of a binary system. In U.S. Pat. No. 3,338,165 Minnick teaches how to make stable explosive compositions by adding a sensitizer, in the form of resin balloons, to nitromethane. He mentions in the patent that it is well known that amines (particularly ethylenediamine) will sensitize nitromethane so that it will detonate with a blasting cap. He continues to say that these mixtures become unstable and decompose after a few days. Not mentioned is that most of these sensitizing agents are very toxic and difficult to work with safely. The basis of this patent is that by entrapping air into the nitromethane liquid, by means of micro balloons (resin, glass, etc.), it can be made cap-sensitive. However since the balloons will float to the surface of pure nitromethane, a thickening (gelling) agent must be added to prevent this.

Another U.S. Pat. No. 3,977,921 by Chandler seeks to overcome some of the problems of using the balloon method of Minnick by achieving air entrapment sensitization by means of an open celled polymeric foam material.

U.S. Pat. No. 4,925,505 of Baker, et al., discloses a means of making a foamable nitromethane composition by the addition of stabilizers, thickeners, sensitizing and foaming agents. It also teaches the addition of metals, including aluminum, to enhance the total energy of the system. The idea of this invention was that the foam would be applied to a mine field and then detonated. Two problems with this method is the very low density of the foam, thus low velocity. Another problem is the useable life of the foam after its application. This would greatly vary depending on conditions such as temperature, wind, sunlight, etc.

To those skilled in the art, it is commonly known that the addition of aluminum to many explosive compositions (usually water gels) not only adds energy, but also increases its sensitivity. As described in U.S. Pat. No. 4,115,165, Machacek describes such an addition of aluminum to typical water gel mixtures (nitromethane is not mentioned in this patent). Further, Machacek teaches the use of aluminum coated with stearic acid which give it a hydrophobic property. This causes air bubbles to cling to the surface of the aluminum particles. As noted before, the incorporation of air bubbles into explosive mixtures increases the sensitivity.

U.S. Pat. No. 5,226,986, previously cited, also explains the use of mixtures of nitromethane and nitroethane as the oxidizing liquid and aluminum fuel granules having an average particle size within the range of 1/64 to 1/4 inch and an average bulk density within the range of 0.2 to 1.0 grams/cc. Also, this patent describes the resultant explosive as being a blasting agent requiring a one pound booster for initiation, not a cap sensitive, small diameter mixture.

U.S. Pat. No. 6,405,627 by Anderson describes a kit for demining operations utilizing sensitized nitroparaffins, to include nitromethane and nitroethane, as the explosive means. As with previous patents, the use of microspheres is the primary method of sensitization. The patent also describes the use of fumed silica as a thickening agent. In claim 12, Anderson also mentioned the addition of powdered aluminum in addition to the microspheres. In the description of the patent, he does not explain the purpose of the aluminum.

(25) References Cited:
U.S. patents

| | | |
|---|---|---|
| 3,338,165 | August 1967 | Minnick |
| 3,718,512 | February 1973 | Hurst |
| 3,977,921 | August 1976 | Chandler |
| 4,115,165 | September 1978 | Machacek |
| 4,925,505 | May 1990 | Baker, et al. |
| 5,226,986 | July 1993 | Hansen, et al. |
| 6,405,627 | June 2002 | Anderson |

Pure nitromethane is actually a very powerful explosive. However, without the addition of some additives or modifiers, it is so insensitive that it is classified as a "Flammable Liquid" for transportation purposes. Pure nitromethane will not usually detonate unless it is subjected to extreme shock and/or confinement at elevated temperatures. Most of the efforts to make a usable nitromethane based explosive have centered on adding dangerous amine compounds and/or incorporating entrapped air bubbles by some means. These air bubbles, while having the desired result of sensitization, have the undesired result of decreasing the density, and thereby lowering the velocity. Further, since these air bubble means are non-energetic, the per unit volume energy is also decreased.

There is a need for another high energy, binary explosive compound. Although ammonium nitrate and nitromethane systems provide a good product, a binary explosive with a higher velocity and total energy would be able to perform tasks that are currently not possible. There are many commercial and military applications where such an explosive would be very useful. If this new binary explosive was in liquid form after mixing, it would be particularly attractive because of its ability to be poured into and fill any container.

BRIEF SUMMARY OF THE INVENTION

The present invention is a two component explosive composition and its formulation consists of nitromethane liquid and finely divided aluminum powder containing stearic acid.

Objects of the present invention include providing a binary explosive having the following properties:

- After mixing, it would be liquid and pourable;
- The individual components would not be classified as explosives;
- The components would not be too dangerous or toxic to handle safely during the mixing process;
- The components would have excellent shelf life under non-ideal storage conditions;
- After mixing, the explosive would be stable and usable after an extended time and at a broad temperature range;
- Have a high detonating velocity and high total energy;
- Have a small critical diameter (the material would support detonation in a length of small diameter tube), ideally, less than one half inch;
- Be usable as an explosive means for shaped charges (both linear and conical), flyer plate and explosively formed projectile charges;
- Have an adjustable sensitivity, depending on the mixture proportions;
- Be easy and quick to mix;
- Have a variety of mixing options: mixing in the container it is to be used in, mixing externally in bulk and then pouring it into the container it is to be used in;
- Must be cap and detonation cord sensitive through the container it is to be used in;
- The mixture would be detonable for at least 24 hours without additional agitation;
- The mixture would not be "bullet sensitive."

DETAILED DESCRIPTION OF THE INVENTION

Figure 1:
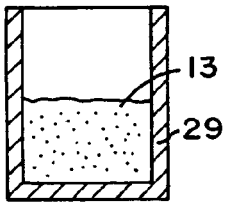
FIG. 1 is a sectional view of a mixing or storage container including a quantity of aluminum powder for use in the present invention.

The multi-component liquid explosive 11 of the present invention comprises, in general, a mixture 12 of aluminum powder 13 containing stearic acid; and nitromethane 15. That is, the preferred embodiment of the explosive 11 of the present invention is a two component explosive composition, compound or mixture 12, consisting of a finely divided aluminum powder 13 containing stearic acid, and a nitromethane liquid 15. In order to make an explosive 11 as a compound or mixture 12 of the two individual nonexplosive components, the two components (i.e., the aluminum powder 13 and nitromethane 15) are simply added together in the proper proportions and shaken by hand. The resulting mixture 12 has the consistency of heavy cream, and is detonable at 70 degrees Fahrenheit in a diameter of one inch or greater with a standard commercial number 8 blasting cap.

The aluminum powder 13 acts as a sensitizer to the nitromethane 15, causing the mixture 12 to become cap sensitive, the aluminum powder 13 then reacts with the products of the detonation behind the reaction front thereby adding increased energy to the total explosion. The chemical reaction is as follows:

$$\underset{\text{(NITROMETHANE)}}{2CH_3NO_2} \longrightarrow 2CO + 2H_2O + H_2 + N_2$$

Then:

$$2H_2O + 11/3Al \longrightarrow 2/3Al_2O_3 + 2H_2$$

Those skilled in the art of explosive formulary will appreciate that the aluminum is reacting with the detonation by-products, particularly the $H_2O$ which is in the form of water vapor. The water vapor acts as an oxidizer to the aluminum to form $Al_2O_3$ plus hydrogen gas. The mixture 12 described here (i.e., the aluminum powder 13 and nitromethane 15) does not require the addition of air-entrapping means such as micro-balloons for sensitivity. It has been found that these micro-balloons decrease the detonation velocity. It has been found that the aluminum powder 13 described here (containing or preferably coated with stearic acid) requires no further thickening agents in order to keep the aluminum powder 13 in suspension in the nitromethane 15.

The aluminum powder 13 preferably has an average particle size of 5 to 50 microns and a surface area of 0.5 to 2 square meters per cubic centimeter containing 0.1 to 5% stearic acid by weight.

The preferred aluminum powder 13 is manufactured by Eckart America L.P. of Louisville, Ky. The Eckart Part Number is SDF 2-382. It is described as a medium grade, dedusted, leafing aluminum flake powder with the following characteristics:

Nonvolatile Matter,
99% minimum 325 Mesh Retention,
2% maximum Average particle size,
16 micron particle size,
1.06 square meters per cubic cm,
Weight per Solid Gallon-21.06 lbs per gallon,
Bulking Value-0.047 gal/lb,
Teflon-0.1%,
Stoddard Solvent-1% to 2%,
Stearic Acid-1% to 2%.

This aluminum powder 13 is classified as a Flammable Solid by the U.S. DOT.

The nitromethane 15 is standard industrial grade and is commonly available as a solvent or racing fuel additive. It is classified as a Flammable Liquid by the U.S. DOT.

Both components (the aluminum powder 13 and nitromethane 15) are easily shipped by common carrier and can meet the definition of "Limited Quantity" when properly packaged. Neither is considered an explosive before mixing and therefore are not subject to explosive storage according to ATF regulations. Although both components are classified as hazardous, neither is particularly toxic and only require minimal protection and care when handling. By way of comparison, the nitromethane 15 is about the same as kerosene according to the Material Safety Data Sheet (MSDS). The aluminum powder 13 is basically a nuisance dust according to its MSDS.

Both of the individual components (the aluminum powder 13 and the nitromethane 15) and the completed mixture 12 are very stable when packaged in High Density Polyethylene (HDPE) bottles or bags. This is important because these types of materials are typically stored in unusually hot and cold environments. For example, if the explosive 11 is used in the desert for demining operations, the component parts (the aluminum powder 13 and the nitromethane 15) would normally be stored for long period of time in steel shipping containers in the hot sun. The same would be true for the opposite extreme when the explosive 11 is being used for avalanche control.

Figure 4:
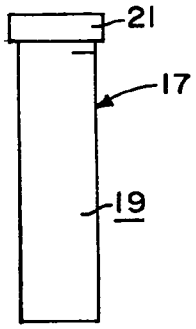
FIG. 4 is an elevational view of a bottle having a screw-on top for use in the present invention.
Figure 5:
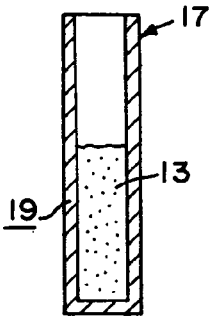
FIG. 5 is a sectional view of the bottle of FIG. 4 with the top removed and including a quantity of aluminum powder for use in the present invention.
Figure 6:
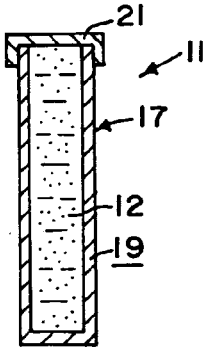
FIG. 6 is a sectional view of one embodiment of the explosive of the present invention, including the bottle of FIG. 4.
Figure 7:
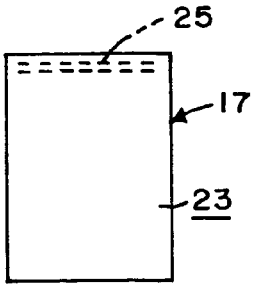
FIG. 7 is an elevational view of a bag having a zip-lock closure for use in the present invention.
Figure 8:
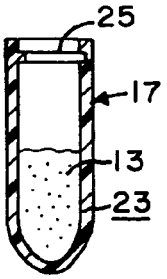
FIG. 8 is a sectional view of the bag of FIG. 4 with the zip-lock closure opened and including a quantity of aluminum powder for use in the present invention.
Figure 9:
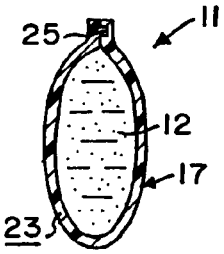
FIG. 9 is a sectional view of another embodiment of the explosive of the present invention, including the bag of FIG. 7.
Figure 10:
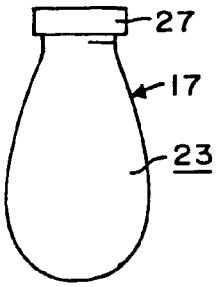
FIG. 10 is an elevational view of a bag having a screw-on closure for use in the present invention.
Figure 11:
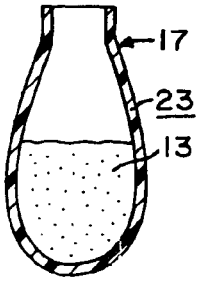
FIG. 11 is a sectional view of the bag of FIG. 10 with the screw-on closure opened and including a quantity of aluminum powder for use in the present invention.
Figure 12:
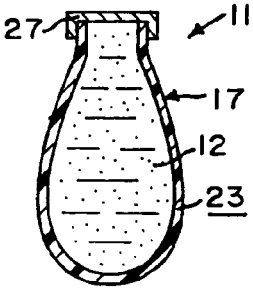
FIG. 12 is a sectional view of another embodiment of the explosive of the present invention, including the bag of FIG. 10.

The explosive 11 of the present invention preferably includes a container or vessel 17 for containing the aluminum powder 13 and nitromethane 15. The vessel 17 is preferably reclosable, so that it can first be opened to receive the aluminum powder 13 and nitromethane 15, and then be closed, tightly sealed, etc. The vessel 17 may be constructed in various specific sizes and designs, by various manners, and out of various materials depending on specific use, etc., as will now be apparent to those skilled in the art. Thus, for example, the vessel 17 can be a bottle 19 molded or otherwise formed out of plastic or the like with a screw-on lid or top 21 (see FIGS. 4–6). Alternatively, the vessel 17 may consist of a plastic bag 23 having a zip-lock closure 25 (see FIGS. 7–9) or a screw-on closure 27 (see FIGS. 10–12) heat sealed to the body of the plastic bag 23 as will now be apparent to those skilled in the art. Depending on specific use, the vessel 17 may be conical shaped, or may be linear shaped, etc. Alternatively, the vessel 17 may include a tube or hose of any diameter or length; may contain or include a flyer plate of any size; or may contain or include an explosively formed projectile, etc., as will now be apparent to those skilled in the art. The vessel 17 may include the liner and casing of a shaped charge of any specific design well known to those skilled in the art.

The explosive 11 may be designed to be used as a breaching charge to make holes in walls or to clear obstacles; may be designed to be used as a booster for other, less sensitive explosives such as a blasting agent; may be designed to be used as a demolition charge, as a mine clearing charge, or as an avalanche control charge.

Several tests were conducted on the mixture 12. A cartridge (1¼ inches in diameter by 7 inches long) of the liquid explosive 11 was embedded in crushed, dry ice for one and a half hours. The cartridge fully detonated when initiated with a standard blasting cap. In another test, a similar cartridge was placed upright and buried in the ground for forty eight hours. Again, the undisturbed cartridge fully detonated when initiated with a standard blasting cap.

The mixture 12 should contain a minimum of 5% of aluminum powder 13 in relation to nitromethane 15 by weight. That is, the preferred mixture 12 is about 1 to 1.2 ounces of aluminum powder 13 to 6 ounces of nitromethane 15 by weight. This gives a thickness (viscosity) and pourability of heavy cream. Practice has shown that more aluminum powder 13 can be added until the mixture 12 becomes more of a paste than a liquid. In this state, the explosive mixture 12 is somewhat more sensitive. Perhaps because of its increased density, tests have further shown it to have more dramatic effects against steel targets and an obvious increase in overall energy.

The method of making the multi-component liquid explosive 11 of the present invention includes the steps of providing a quantity of aluminum powder 13 containing stearic acid; providing a quantity of nitromethane 15; and mixing a portion of the quantity of aluminum powder 13 with a portion of the quantity of nitromethane 15.

There are two primary or preferred methods of mixing the composition. The first method is by packaging the proper amount of aluminum powder 13 in the container or vessel 17 to be utilized as the explosive container (see, e.g., FIGS. 5, 8 and 11). The nitromethane 15 is then poured into the vessel 17 until the aluminum powder 13 floats to the top. The vessel 17 is then closed (e.g, the lid or top 21 is screwed on the bottle 19), and then vessel 17 is shaken. The aluminum powder 13 will be wetted at this point and more nitromethane 15 is added until the vessel 17 is full or almost full. After reclosing the vessel 17 and shaking the vessel 17 again, the explosive 11 is ready to use. The size of the vessel 17 is not important so long as it contains the proper amount of aluminum powder 13 in relation to the nitromethane 15 as previously noted. It should be noted that this method might include providing a number of vessels 17, each having a premeasured, appropriate amount of aluminum powder 13 therein.

Figure 2:
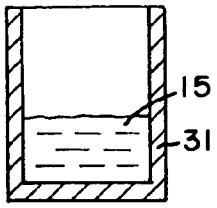
FIG. 2 is a sectional view of a storage container including a quantity of nitromethene for use in the present invention.
Figure 3:
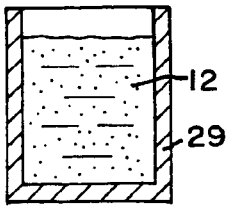
FIG. 3 is a sectional view of the mixing container of FIG. 1 including a quantity of aluminum powder and a quantity of nitromethene for use in the present invention.

Another method of mixing is an extension of the first method. Instead of mixing the aluminum powder 13 and nitromethane 15 within the vessel 17 to be used as the housing for the explosive 11, they are mixed externally in bulk, then poured into a one or more vessels 17 to be used. For example, a gallon jug or mixing container 29 could be used to initially contain the proper amount of aluminum powder 13 (see FIGS. 1 and 3), and nitromethane 15 could be initially held in a storage jug or container 31 (see FIG. 2), and added or poured into the mixing container 29 with the aluminum powder 13 as detailed in the previous paragraph. Once properly mixed, the mixture 12 could then be distributed (i.e. poured) into one or more 8 ounce vessels 17 for use. This method would be faster if many vessels 17 are to be used at one time. Also, from an inventory standpoint, a number of pre-filled one gallon mixing and storage containers 29, 31could be kept on hand and a variety of explosive vessels 17 of different shapes and sizes could be kept in non-secure storage for use. Another container for bulk mixing would be heavy plastic bags or bladders with screw on lids. The advantage of such bags is that the excess air can be evacuated after packaging the aluminum powder 13 within, thereby reducing the volume of the package.

It has been found that this explosive 11 works very well for use in shaped charges. For example, a small (about 1¼ inch diameter) conical shaped charge was fabricated from standard PVC fittings and an oil well perforator sintered copper liner. Using about a two inch stand off and about one ounce of the explosive mixture 12, a two inch thick piece of plate steel was completely penetrated. Besides demonstrating high velocity and high energy, it is believed that this explosive 11 works exceptionally well in these charges because of the uniform density and the intimate contact of the liquid with the liner.

In another test, the liquid explosive 11 was poured into a 900 grain per foot linear copper shaped charge shell from which the original explosive filler (RDX) had been removed. The length of the shell was approximately twelve inches. The maximum cross section dimension of this size shell is approximately 3/16 of an inch. Upon initiation of one end of the liquid explosive filled shell, the detonation propagated full length in the shell and cut a steel target ⅜ inch (1.48 centimeters) thick, placed one inch (2.54 centimeters) away.

As mentioned previously, it has been found that the sensitivity of this explosive 11 can be varied by adjusting the amount of aluminum powder 13. Less aluminum powder 13 means less sensitivity. Also, the detonation velocity, and to some extent the sensitivity, can be varied by the addition of nitroethane to the nitromethane 15. Noticeable reductions occur when the mixture contains about 10% nitroethane.

Without additional thickening agents, the nitromethane 15 and aluminum powder 13 mixture as previously described will remain homogeneous for several hours after being shaken. The exact time depends on the proportions of nitromethane 15 and aluminum powder 13, as well as temperature and other factors. In any case, after some period of time, some separation of the aluminum powder 13 and the nitromethane 15 will occur. If a blasting cap is touching the lower portion of the vessel 17 (in other words, where the aluminum powder 13 is in suspension), the detonation will be successful. In most cases, the explosive 11 would be used well before this separation happens. However, if it is desired that the explosive 11 remain fully homogeneous indefinitely, polymethyl methacrylate powder (also called PMMA, a commonly available industrial and cosmetic material) and/or amorphous fumed silica (as marketed under the name CAB-O-SIL, M-5 by the Cabot Corporation of Tuscola, Ill., USA) can be added to the nitromethane 15 or to the aluminum powder 13 before mixing and will help the aluminum powder 13 to stay suspended by thickening the mixture. An appropriate amount has been found to be approximately 1 to 4% or 5% by weight of PPMA and/or amorphous fumed silica. Other thickening agents are also known to those skilled in the art. Although tests have shown that the sensitivity is not effected by the addition of these materials, they are non-energetic and therefore slightly reduce the velocity and overall energy per unit volume. The invention described here, however, in no way is dependent upon the addition of these materials.

As previously mentioned, binary explosives are usually not as cost effective and convenient as traditional explosives. However, for the low volume, specialized user, they can save a great deal of time and expense in the area of transportation and logistics. Because they are not mixed until just before use, the dangers of transportation and handling are greatly reduced. It is envisioned this new nitromethane 15 and aluminum powder 13 mixture can be used for the following applications:

As a cartridged explosive in small to medium bore hole applications;

As a field mixed and dispensed explosive filler for a variety of shaped charges, flyer plate charges, demolition and breaching charges for military and commercial demolition operations;

As a counter charge for the detonation of land mines and bombs, either in some type of specially designed container or shaped charge;

As a filler for avalanche control charges;

As a booster for blasting agents;

Metal hardening applications;

Forest fire fighting applications where the liquid explosive 11 can be pumped into a length of hose, then detonated in order to clear the ground of flammable debris.

Although the present invention has been described and illustrated with respect to a preferred embodiment and preferred uses therefor, it is not to be so limited since modifications and changes can be made therein which are within the full intended scope of the invention.

What is claimed is:

1. A field mixable, binary, liquid explosive consisting of:

(a) a non-explosive solid component including aluminum powder containing stearic acid; and (b) a non-cap sensitive liquid component including nitromethane;

whereby said solid and liquid components can be combined and mixed together in the field to produce a cap sensitive explosive.

2. The explosive of claim 1 in which said aluminum powder has an average particle size of 5 to 50 microns and a surface area of 0.5 to 2 square meters per cubic centimeter, and contains 0.1 to 5% stearic acid by weight.

3. The explosive of claim 1 in which said aluminum powder and said nitromethane are mixed in the ratio of about 1 to 1.2 ounces of said aluminum powder to about 6 ounces of said nitromethane, by weight.

4. A method of making a field mixable, binary liquid explosive consisting of the steps of:

(a) providing a non-explosive solid component including a quantity of aluminum powder containing stearic acid;

(b) providing a non-cap sensitive liquid component including a quantity of nitromethane; and (c) combining and mixing said solid component with said liquid component in the field to produce a cap sensitive explosive.

5. The method of claim 4 in which said aluminum powder has an average particle size of 5 to 50 microns and a surface area of 0.5 to 2 square meters per cubic centimeter, and contains 0.1 to 5% stearic acid by weight.

6. The method of claim 4 in which said aluminum powder and said nitromethane are mixed in the ratio of about 1 to 1.2 ounces of said aluminum powder to about 6 ounces of said nitromethane, by weight.

* * * * *